US007900559B2

(12) United States Patent
Rasch et al.

(10) Patent No.: US 7,900,559 B2
(45) Date of Patent: Mar. 8, 2011

(54) MANDREL LOCKING UNIT FOR PRINTING ROLLER MANDRELS IN A ROTARY PRINTING MACHINE

(75) Inventors: Georg Rasch, Havixbeck (DE); Hans-Joerg Mieseler, Ibbenbueren (DE)

(73) Assignee: Windmoeller & Hoelscher KG, Lengerich (DE)

( * ) Notice: Subject to any disclaimer, the term of this patent is extended or adjusted under 35 U.S.C. 154(b) by 486 days.

(21) Appl. No.: 10/557,826

(22) PCT Filed: May 18, 2004

(86) PCT No.: PCT/EP2004/005488

§ 371 (c)(1),
(2), (4) Date: Nov. 23, 2005

(87) PCT Pub. No.: WO2004/103706

PCT Pub. Date: Dec. 2, 2004

(65) Prior Publication Data

US 2006/0266236 A1 Nov. 30, 2006

(30) Foreign Application Priority Data

May 23, 2003 (DE) ..... 103 23 805

(51) Int. Cl.
*B41F 13/30* (2006.01)
*B41F 13/44* (2006.01)

(52) U.S. Cl. ..... 101/216; 101/247; 101/375

(58) Field of Classification Search ..... 101/216, 101/247, 375, 480; 384/24, 537, 438, 584, 384/428, 442–444; *B41F 13/30, 13/44*
See application file for complete search history.

(56) References Cited

U.S. PATENT DOCUMENTS

| | | | | |
|---|---|---|---|---|
| 2,460,504 | A * | 2/1949 | Huebner | 101/479 |
| 3,147,702 | A | 9/1964 | Martin | |
| 4,083,205 | A * | 4/1978 | Clarke et al. | 68/5 C |
| 5,562,358 | A * | 10/1996 | Okamoto et al. | 403/371 |
| 5,735,206 | A * | 4/1998 | Rossini | 101/216 |
| 5,974,968 | A * | 11/1999 | Achelpohl et al. | 101/247 |
| 6,473,954 | B1 * | 11/2002 | Rosberg et al. | 29/243 |
| 2003/0145472 | A1 * | 8/2003 | Swift | 30/374 |

FOREIGN PATENT DOCUMENTS

DE 197 05 369 9/1998

* cited by examiner

*Primary Examiner* — Judy Nguyen
*Assistant Examiner* — Jennifer Simmons
(74) *Attorney, Agent, or Firm* — Jacobson Holman PLLC

(57) ABSTRACT

A mandrel-locking unit for a rotary printing machine has a mandrel-mounting element that surrounds print roller mandrels in an inner bearing for mounting a mandrel-supporting surface and into which the mandrel-mounting element can be slid such that the mandrel-supporting surface is released by the sliding movement. The unit has a pressurizing medium cylinder that provides the force required for the sliding movement and a piston, which delimits a pressure chamber of the pressurizing medium cylinder at a boundary surface and which is in contact with the mandrel-mounting element at a connecting point and conveys to the mandrel mounting element the pressure required for the sliding movement. A feature of the unit is that the distance between the boundary surface and the connecting point is smaller than the maximum stroke of the piston in the pressurizing medium cylinder.

17 Claims, 1 Drawing Sheet

MANDREL LOCKING UNIT FOR PRINTING ROLLER MANDRELS IN A ROTARY PRINTING MACHINE

CROSS-REFERENCE TO RELATED APPLICATION

This is a nationalization of PCT/EP2004/005488 filed 18 May 2004 and published in German.

BACKGROUND OF THE INVENTION

1. Field of Invention

The present invention relates to a mandrel-locking unit having a mandrel-mounting element that has a hollow body and that accommodates therein a bearing for mounting a print roller mandrel. A pressurizing medium cylinder has a pressure chamber and a piston located therein for sliding the mandrel-mounting element between a mounting position and a release position.

2. Description of the Prior Art

The processing of different print jobs frequently necessitates the replacement of printing plates. Therefore print rollers are known from the prior art that comprise print roller mandrels whose print roller sleeves, the so-called sleeves—can be pulled off and put back on again. In order to replace the sleeves without having to remove the print roller from the printing machines, the print roller mandrels are arranged such that their one end usually floats. The free end is embraced by a bearing during the printing operation. Within the framework of the present invention, all rollers involved in a printing process are referred to as print rollers.

The patent application DE 197 05 369 A1 illustrates, for example, a printing machine of such type. A bearing block is assigned to every roller involved in the printing process. The bearing block can be displaced in relation to the roller after the connection of the bearing to the roller is released. The actual bearing is located in a bearing head that can be displaced using guides extending parallel to the axis of the roller. The process takes place by means of a piston cylinder unit. The unit consisting of the bearing, the mandrel-mounting element, the guides, and the piston cylinder is often also referred to as mandrel-locking unit.

However, the disadvantage of this design is that the mandrel-locking unit has an overall depth that results from its design and that is composed of the depth of the bearing piston and the maximum stroke of the piston cylinder unit. This overall depth brings about a space requirement on the operating side of the printing machine. This space requirement has a restrictive effect on the comfortable operability of the printing machine.

The patent application U.S. Pat. No. 3,147,702 suggests a similar mandrel-locking unit in which, however, it is not the bearing, but instead the roller journal that is pulled off from the roller. The shaft journal is thus a component of the mandrel-locking unit. In this arrangement, the shaft journal is surrounded by the piston that is designed as a hollow space. However, this mandrel-locking unit also exhibits the disadvantage of a large overall depth.

SUMMARY OF THE INVENTION

Therefore, the objective of the present invention is to suggest a mandrel-locking unit that has a more compact design and a lower overall depth.

This objective is achieved by a mandrel-locking unit having the features described herein.

Here, the boundary surface, as described herein, is the part of the surface of the piston that delimits the pressure chamber of the pressurizing medium cylinder.

The mandrel-mounting element is a component that is suited for the purpose of mounting the mandrel on the mandrel-supporting surface. Since the mandrel is supported on its supporting surface with the help of bearings, it is also usually embraced by this bearing. As a rule, the mandrel-mounting element is designed as a sleeve. In order to slide the mandrel-mounting element, it is connected to the piston at a connecting point.

In a first advantageous embodiment of the present invention, the distance between the boundary surface and the connecting point is smaller than three quarters of the maximum stroke of the piston in the cylinder.

In a second particularly preferred embodiment of the present invention, the distance between the boundary surface and the connecting point is smaller than half of the maximum stroke of the piston in the cylinder. Such an embodiment provides a good compromise between a compact design and a secure guide of the mandrel-mounting element in the guide sleeve, for instance, to prevent a tilting effect. Of course, the distance can also be significantly smaller.

Another advantage of this embodiment of the present invention is that, if enabled by the design, the displacement area of the mandrel-mounting element and the pressure chamber into which the piston can move, merge into one another in the axial direction. In this manner it is possible, among other things, to completely omit the use of the piston rod that in known mandrel-locking units is at least as long as the maximum stroke of the piston.

In case the pressure chamber and the displacement area merge into one another, it is advantageous if the inner diameter of the pressurizing medium cylinder is larger than the outer diameter of the mandrel-mounting element.

In this manner a direct transfer of force is ensured from the piston onto the mandrel-mounting element.

It is particularly advantageous if the piston is a disk without a piston rod. Since the mandrel-mounting element would then take over the guide function of the piston rod, the former must be provided with a larger overall length than the maximum stroke of the piston.

In order to ensure a secure connection between the piston and the mandrel-mounting element, it is advantageous to provide a screwed connection between these two elements.

In a third advantageous embodiment of the present invention, both the mandrel-mounting element as well as the pressurizing medium cylinder are designed as circular cylinders.

The axes of symmetry of these two circular cylindrical components extend parallel to one another, without being aligned with one another. Thus the result is an easy non-centered connection between these two components with the advantage that the mandrel-mounting element can be arranged on one side of the guide bushing. In a printing machine with an interaction of two print rollers having a small outer diameter, the minimum outer diameter is determined by the dimensions of the mandrel-locking unit. Should the mandrel-mounting element be arranged in a displaced manner, the minimum distance can be reduced again so as to enable the reduction of the minimum print repeat range of the printing machine.

The present invention can be used advantageously in flexographic printing machines or gravure printing machines. However, it can also be used in printing machines that operate according to other principles.

BRIEF DESCRIPTION OF THE DRAWINGS

A preferred embodiment of the present invention is set forth in the following description in conjunction with the drawing, of which the individual Figures illustrate:

Figure 1:
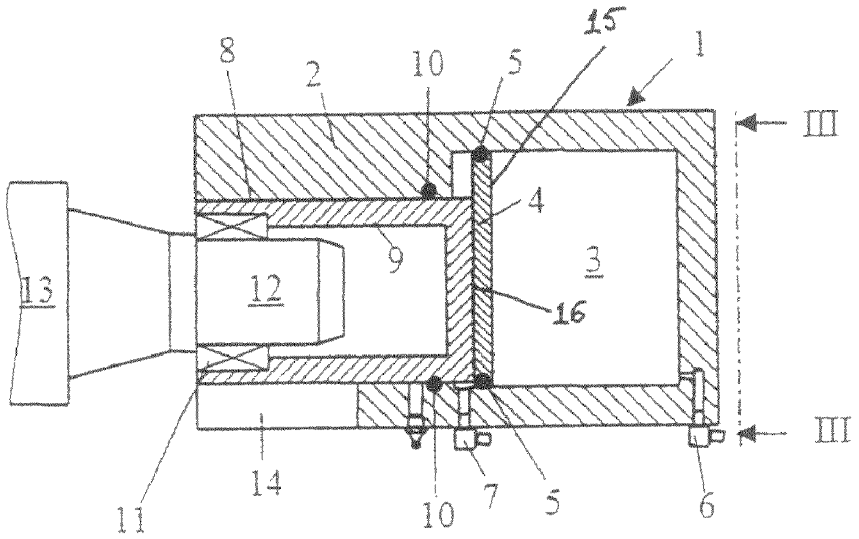
Figure 2:
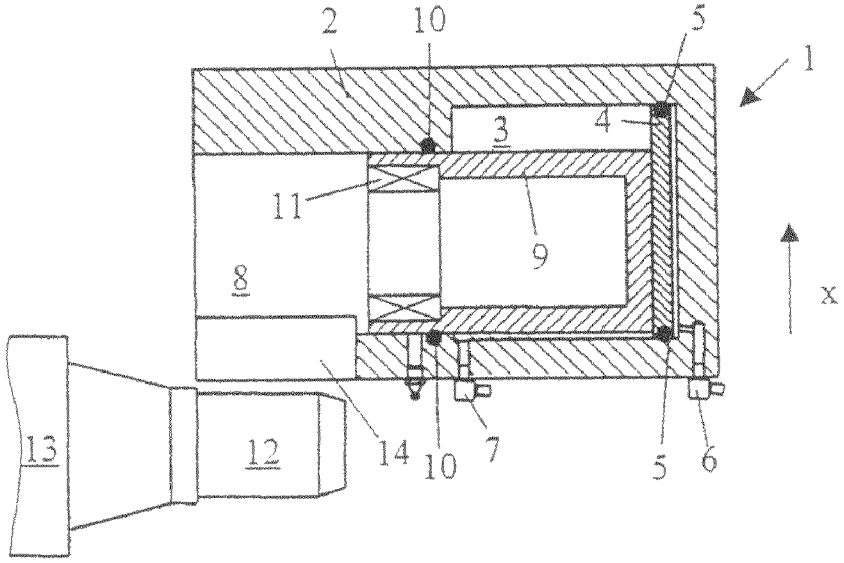
Figure 3:
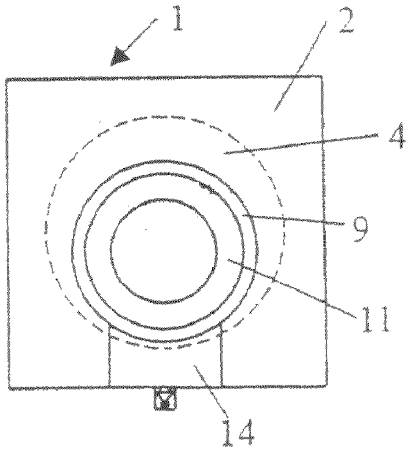

| | |
|---|---|
| FIG. 1 | a mandrel-locking unit according to the invention with enclosed mandrel-supporting surface, |
| FIG. 2 | a mandrel-locking unit according to the invention with a released mandrel-supporting surface, |
| FIG. 3 | view of the section along III-III of the mandrel-locking unit illustrated in FIG. 1. |

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

FIGS. 1 and 2 illustrate a mandrel-locking unit 1 substantially comprising a pressurizing medium cylinder 2. The pressurizing medium cylinder 2 has a pressure chamber 3 into which a piston 4 having a boundary surface 15 can be slid. The piston 4 has on its outer circumference a sealing ring 5 that, as is known, prevents compressed air from one side of the piston 4 from reaching its other side. The compressed air is fed into the pressure chamber by the compressed air inlets 6, 7. The pressurizing medium cylinder 2 has, in addition to the pressure chamber 3, a guide area 8 in which the mandrel-mounting element 9 is supported slideably. The pressure chamber 3 and the guide area 8 are separated from one another by the mandrel-mounting element 9 and the sealing ring 10. In one section with an extended inner diameter, the mandrel-mounting element 9 supports a bearing 11, for instance a roller bearing that can enclose the mandrel-supporting surface 12 of the print roller mandrel 13. In order to transfer the force that acts due to the supply of compressed air on the piston 4 onto the mandrel-mounting element 9, both components are connected to one another at a connecting point 16 in a manner that is not illustrated elaborately here. This connection is formed advantageously by using a screw.

In the operating state illustrated in FIG. 1, compressed air is applied to the pressure, chamber by means of the compressed air inlet 6 so as to move the piston 4 in the axial direction onto the print roller mandrel 13. The guiding of the mandrel-mounting element 9 in the pressurizing medium cylinder 2 ensures the axial guiding of the piston 4. During the printing operation, pressure is applied to the pressure chamber 3 so as to prevent any unwanted separation of the bearing 11 and the mandrel-supporting surface 12.

In order to achieve the operating state illustrated in FIG. 2, compressed air is applied to the pressure chamber by means of the compressed air inlet 7 so as to move the piston 4 and with it the mandrel-mounting element 9 away from the print roller mandrel 13 and into its end position illustrated in FIG. 2. After the release of the mandrel-supporting surface 12, the print roller mandrel 13 and the mandrel-locking unit 1 can be moved in relation to one another. In the illustrated embodiment, the mandrel-locking unit 1 is moved in the direction of the arrow x. For this purpose the pressurizing medium cylinder 2 has a break-through 14 at least one point.

FIG. 3 illustrates the arrangement of the piston 4 and the mandrel-mounting element 9 that can be displaced easily in order to minimize the distance between the mandrel-mounting element 9 and the outer edge of the pressurizing medium cylinder 2 on the side of the break-through 14.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of Reference Symbols | |
|---|---|
| 1 | Mandrel-locking unit |
| 2 | Pressurizing medium cylinder |
| 3 | Pressure chamber |
| 4 | Piston |
| 5 | Sealing ring |
| 6 | Compressed air inlet |
| 7 | Compressed air inlet |
| 8 | Guide area |
| 9 | Mandrel-mounting element |
| 10 | Sealing |
| 11 | Bearing |
| 12 | Mandrel-supporting surface |
| 13 | Print roller mandrel |
| 14 | Break-through |
| x | Direction of movement of the mandrel-locking unit |

What is claimed is:

1. A mandrel-locking unit for a rotary printing machine comprising a mandrel-mounting element that forms a hollow body and accommodates in an enclosed form in an interior thereof a bearing for mounting a print roller mandrel having a mandrel-supporting surface and that is slideable between a mounting position in which the print roller mandrel is in engagement with the bearing and a release position in which the print roller mandrel is out of engagement with the bearing, a pressurizing medium cylinder including a pressure chamber with a piston located therein for sliding the mandrel-mounting element between the mounting position and the release position, the piston delimiting the pressure chamber at a boundary surface and being connected to the mandrel-mounting element at a connecting point for a transfer of force required for sliding the mandrel-mounting element, the boundary surface being a surface of the piston that is on a pressure chamber side of the piston, a distance between the boundary surface and the connecting point being smaller than a maximum stroke of the piston in the pressurizing medium cylinder, an inner diameter of the pressurizing medium cylinder being larger than an outer diameter of the mandrel-mounting element, and the pressurizing medium cylinder including a break-through that is open in the release position of the mandrel-mounting element such that the print roller mandrel and the mandrel-locking unit are separable from one another by a movement in relation to one another.

2. The mandrel-locking unit pursuant to claim 1, wherein the distance between the boundary surface and the connecting point is smaller than three quarters of the maximum stroke of the piston in the pressurizing medium cylinder.

3. The mandrel-locking unit pursuant to claim 1, wherein the distance between the boundary surface and the connecting point is smaller than half of the maximum stroke of the piston in the pressurizing medium cylinder.

4. The mandrel-locking unit pursuant to claim 1, wherein parts of the mandrel-mounting element are displaceable in the pressurizing medium cylinder.

5. The mandrel-locking unit pursuant to claim 1, wherein the piston is a disk without a piston rod.

6. The mandrel-locking unit pursuant to claim 1, wherein the connecting point between the piston and the mandrel-mounting element has a threaded connection.

7. The mandrel-locking unit pursuant to claim 1, wherein the mandrel-mounting element and the pressurizing medium cylinder are shaped as circular cylinders and have axes of symmetry that extend parallel to a distance between one another.

8. A mandrel-locking unit for a rotary printing machine, comprising:

a mandrel-mounting element configured to accommodate in an interior thereof a bearing for mounting a print roller mandrel having a mandrel-supporting surface, the mandrel-mounting element being slideable between a mounting position in which the print roller mandrel is in contact with the bearing and a release position in which the print roller mandrel is out of contact with the bearing; and a pressurizing medium cylinder including a pressure chamber with a piston located therein for sliding the mandrel-mounting element between the mounting position and the release position, and a break-through that is open in the release position of the mandrel-mounting element such that the print roller mandrel and the mandrel-locking unit are separable from one another by a movement in relation to one another, an inner diameter of the pressurizing medium cylinder being larger than an outer diameter of the mandrel-mounting element, the piston (i) having a boundary surface that delimits an end of the pressure chamber and (ii) being connected to the mandrel-mounting element at a connecting point for a transfer of force required to slide the mandrel-mounting element, the boundary surface being a surface of the piston that is on a pressure chamber side of the piston, and a distance between the boundary surface and the connecting point being less than a distance of a maximum piston stroke in the pressurizing medium cylinder.

9. The mandrel-locking unit according to claim 8, wherein the distance between the boundary surface and the connecting point is less than three-quarters of the maximum piston stroke distance.

10. The mandrel-locking unit according to claim 8, wherein the distance between the boundary surface and the connecting point is less than half of the maximum piston stroke distance.

11. A mandrel-locking unit for a rotary printing machine comprising a mandrel-mounting element that forms a hollow body and accommodates in an enclosed form in an interior thereof a bearing for mounting a print roller mandrel having a mandrel-supporting surface and that is slideable between a mounting position in which the print roller mandrel is in engagement with the bearing and a release position in which the print roller mandrel is out of engagement with the bearing, a pressurizing medium cylinder including a guide area in which the mandrel-mounting element is slidably supported, and a pressure chamber with a piston located therein for sliding the mandrel-mounting element between the mounting position and the release position, the piston delimiting the pressure chamber at a boundary surface and being connected to the mandrel-mounting element at a connecting point for a transfer of force required for sliding the mandrel-mounting element, the boundary surface being a surface of the piston that is on a pressure chamber side of the piston, a distance between the boundary surface and the connecting point being smaller than a maximum stroke of the piston in the pressurizing medium cylinder, an inner diameter of the pressurizing medium cylinder being larger than an outer diameter of the mandrel-mounting element, the pressurizing medium cylinder including a break-through that is open in the release position of the mandrel-mounting element such that the print roller mandrel and the mandrel-locking unit are separable from one another by a movement in relation to one another, and the pressure chamber and the guide area being separated from each other by the mandrel-mounting element and a sealing ring.

12. The mandrel-locking unit according to claim 11, wherein the piston is configured as a disk.

13. The mandrel-locking unit according to claim 12, wherein the distance between the boundary surface and the connecting point equals a thickness of the disk.

14. The mandrel-locking unit according to claim 11, wherein the distance between the boundary surface and the connecting point is essentially zero.

15. The mandrel-locking unit according to claim 11, wherein the sealing ring is disposed circumferentially around the mandrel-mounting element, and between the mandrel-mounting element and the guide area of the pressurizing medium cylinder.

16. A mandrel-locking unit for a rotary printing machine comprising a mandrel-mounting element that forms a hollow body and accommodates in an enclosed form in an interior thereof a bearing for mounting a print roller mandrel having a mandrel-supporting surface and that is slideable between a mounting position in which the print roller mandrel is in engagement with the bearing and a release position in which the print roller mandrel is out of engagement with the bearing, a pressurizing medium cylinder including a pressure chamber with a piston located therein for sliding the mandrel-mounting element between the mounting position and the release position, an inner diameter of the pressurizing medium cylinder being larger than an outer diameter of the mandrel-mounting element, the piston delimiting the pressure chamber at a boundary surface and being connected to the mandrel-mounting element for a transfer of force required for sliding the mandrel-mounting element, the boundary surface being a surface of the piston that is on a pressure chamber side of the piston, a surface of the piston opposite the boundary surface being directly connected to an end surface of the mandrel-mounting element, and the pressurizing medium cylinder including a break-through that is open in the release position of the mandrel-mounting element such that the print roller mandrel and the mandrel-locking unit are separable from one another by a movement in relation to one another.

17. A mandrel-locking unit for a rotary printing machine comprising a mandrel-mounting element that forms a hollow body and accommodates in an enclosed form in an interior thereof a bearing for mounting a print roller mandrel having a mandrel-supporting surface and that is slideable between a mounting position in which the print roller mandrel is in engagement with the bearing and a release position in which the print roller mandrel is out of engagement with the bearing, a pressurizing medium cylinder including a pressure chamber with a disk-shaped piston located therein for sliding the mandrel-mounting element between the mounting position and the release position, an inner diameter of the pressurizing medium cylinder being larger than an outer diameter of the mandrel-mounting element, the piston delimiting the pressure chamber at a boundary surface and being connected to the mandrel-mounting element for a transfer of force required for sliding the mandrel-mounting element, the boundary surface being a surface of the piston that is on a pressure chamber side of the piston, a surface of the piston opposite the boundary surface being directly connected to an end surface of the mandrel-mounting element, the transfer of force being provided by a compressed fluid that acts on the connected piston and mandrel-mounting element, and the pressurizing medium cylinder including a breakthrough that is open in the release position of the mandrel-mounting element such that the print roller mandrel and the mandrel-locking unit are separable from one another by a movement in relation to one another.

* * * * *